US007866327B1

(12) United States Patent
Gueret

(10) Patent No.: US 7,866,327 B1
(45) Date of Patent: Jan. 11, 2011

(54) DEVICE FOR PACKAGING AND APPLYING A COSMETIC, IN PARTICULAR FOR MAKING UP THE LIPS

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 738 days.

(21) Appl. No.: 09/570,934

(22) Filed: May 15, 2000

(30) Foreign Application Priority Data

May 19, 1999 (FR) ..... 99 06346

(51) Int. Cl.
*A45D 40/26* (2006.01)

(52) U.S. Cl. ..... 132/218

(58) Field of Classification Search ..... 132/218, 132/313, 320, 317, 916, 917; 401/126–130, 401/122
See application file for complete search history.

(56) References Cited

U.S. PATENT DOCUMENTS

| | | | | |
|---|---|---|---|---|
| 1,999,642 | A | 4/1935 | Shepherd | |
| 2,001,086 | A | 5/1935 | Villanyi | |
| 2,029,835 | A | 2/1936 | Reichle | |
| 2,231,197 | A | 2/1941 | Scioscia | |
| 2,296,139 | A | 9/1942 | Blair | |
| 2,561,252 | A | 7/1951 | Waring | |
| 2,901,100 | A * | 8/1959 | Mueller et. al. | 401/11 |
| 3,010,140 | A | 11/1961 | Thomas | |
| 3,033,213 | A | 5/1962 | Joss et al. | |
| 3,072,953 | A | 1/1963 | Bunke | |
| 3,084,374 | A | 4/1963 | Ziegler | |
| 3,132,653 | A | 5/1964 | Gazdik | |
| 3,146,806 | A | 9/1964 | Ginsburg | |
| 3,150,220 | A | 9/1964 | Howell | |
| 3,219,045 | A | 11/1965 | Kambersky | |
| 3,334,374 | A | 8/1967 | Watkins, Jr. | |
| 3,662,769 | A | 5/1972 | Vasas et al. | 132/88.7 |
| 3,756,731 | A | 9/1973 | Aubry | 401/122 |
| 3,763,870 | A | 10/1973 | Montgomery et al. | 132/85 |
| 3,921,650 | A | 11/1975 | Montgomery | 132/88.7 |
| 4,165,755 | A | 8/1979 | Cassai | 132/218 |
| 4,219,283 | A * | 8/1980 | Buckley et al. | 401/129 |
| 4,241,743 | A | 12/1980 | Schnabel et al. | 132/218 |

(Continued)

FOREIGN PATENT DOCUMENTS

| | | |
|---|---|---|
| AU | 62340/86 | 2/1987 |

(Continued)

OTHER PUBLICATIONS

Translation of Japanse Patent '009.*

(Continued)

*Primary Examiner*—Robyn Doan
(74) *Attorney, Agent, or Firm*—Oliff & Berridge, PLC

(57) ABSTRACT

A packaging and applicator device comprises a receptacle for containing the substance to be applied, an applicator comprising a rod provided at one end with an applicator element, and a wiper member for wiping the rod and the applicator element while the applicator is being extracted from the receptacle. The applicator element forms an angle with the rod and has an elastically deformable body and/or core capable of deforming elastically to pass through the wiper member while the applicator is being withdrawn, the wiper member deforming substantially less than the applicator element while the applicator element is passing through the wiper member.

98 Claims, 8 Drawing Sheets

U.S. PATENT DOCUMENTS

| | | | | | |
|---|---|---|---|---|---|
| 4,282,891 | A | | 8/1981 | Duceppe | 132/73.5 |
| 4,380,841 | A | | 4/1983 | Thomas | 15/210 B |
| 4,403,624 | A | * | 9/1983 | Montgomery | 132/218 |
| 4,411,282 | A | * | 10/1983 | Wavering | 132/218 |
| 4,428,388 | A | * | 1/1984 | Cassai et al. | 132/317 |
| 4,440,181 | A | | 4/1984 | Scherer | 132/73.5 |
| 4,446,965 | A | | 5/1984 | Montiel | 206/205 |
| 4,458,701 | A | | 7/1984 | Holland | 132/88.7 |
| 4,498,490 | A | * | 2/1985 | Seidler | 132/218 |
| 4,898,193 | A | | 2/1990 | Gueret | 132/218 |
| 4,908,252 | A | | 3/1990 | Carnahan et al. | 428/27 |
| 4,990,016 | A | | 2/1991 | Seidler | 401/268 |
| 5,054,946 | A | | 10/1991 | Morel | 401/122 |
| 5,096,139 | A | * | 3/1992 | Feld et al. | 244/3.1 |
| 5,123,431 | A | * | 6/1992 | Wilson | 132/320 |
| 5,137,038 | A | | 8/1992 | Kingsford | 132/218 |
| 5,137,387 | A | | 8/1992 | Byrd et al. | 401/122 |
| 5,188,131 | A | | 2/1993 | Toll | 132/218 |
| 5,309,929 | A | * | 5/1994 | Toll | 132/218 |
| 5,328,282 | A | | 7/1994 | Charrier et al. | 401/4 |
| 5,349,972 | A | | 9/1994 | Dirksing et al. | 132/218 |
| 5,542,439 | A | | 8/1996 | Gueret | 132/218 |
| 5,556,214 | A | * | 9/1996 | Ascolese | 401/126 |
| 5,697,720 | A | | 12/1997 | Lhuisset | 401/122 |
| 5,716,150 | A | * | 2/1998 | Gueret | 401/129 |
| 5,743,279 | A | * | 4/1998 | Gueret | 132/218 |
| 5,803,638 | A | * | 9/1998 | Gueret | 401/122 |
| 5,816,728 | A | * | 10/1998 | Nardolillo et al. | 401/126 |
| 5,853,011 | A | | 12/1998 | Gueret | 132/218 |
| 5,860,432 | A | | 1/1999 | Gueret | 132/218 |
| 5,876,138 | A | | 3/1999 | Gueret | 481/129 |
| 5,899,622 | A | * | 5/1999 | Gueret | 401/122 |
| 5,918,994 | A | | 7/1999 | Gueret | 401/122 |
| 5,934,292 | A | | 8/1999 | Gueret | 132/320 |
| 5,937,870 | A | | 8/1999 | Gueret | 132/218 |
| 5,961,238 | A | | 10/1999 | de Bruin et al. | 401/122 |
| 6,003,519 | A | * | 12/1999 | Gueret | 132/218 |
| 6,010,265 | A | | 1/2000 | Bouix | 401/122 |
| 6,026,824 | A | * | 2/2000 | Gueret | 132/218 |
| 6,050,273 | A | * | 4/2000 | Lhuisset | 132/317 |
| 6,059,570 | A | * | 5/2000 | Dragan et al. | 433/80 |
| 6,067,997 | A | | 5/2000 | Gueret | 132/320 |
| 6,076,531 | A | * | 6/2000 | Gueret | 132/218 |
| 6,099,183 | A | | 8/2000 | Gueret | 401/119 |
| 6,220,254 | B1 | | 4/2001 | Gueret | 132/313 |
| 6,237,609 | B1 | * | 5/2001 | Vasas | 132/218 |
| 6,280,112 | B1 | * | 8/2001 | Vieu | 401/122 |
| 6,328,495 | B1 | | 12/2001 | Gueret | 401/122 |
| 6,371,129 | B1 | * | 4/2002 | Le Bras-Brown et al. | 132/218 |
| 6,375,374 | B2 | | 4/2002 | Gueret | 401/122 |
| RE38,019 | E | | 3/2003 | Gueret | 132/218 |
| 2002/0014250 | A1 | | 2/2002 | Gueret | |
| 2002/0020426 | A1 | | 2/2002 | Gueret | |
| 2002/0124860 | A1 | | 9/2002 | Gueret | |

FOREIGN PATENT DOCUMENTS

| | | | |
|---|---|---|---|
| CA | 2251997 | | 4/2001 |
| CH | 338327 | | 6/1959 |
| DE | 1 757 096 | | 1/1971 |
| DE | 86 09 637 | U | 9/1986 |
| DE | 197 44 181 | A1 | 4/1999 |
| EP | 0 188 883 | | 7/1986 |
| EP | 0 761 123 | | 3/1997 |
| EP | 0 405 103 | B1 | 8/1997 |
| EP | 0 832 580 | | 4/1998 |
| EP | 1 236 419 | | 9/2002 |
| EP | 1 236 420 | | 9/2002 |
| EP | 1 236 421 | | 9/2002 |
| FR | 1 246 217 | | 7/1958 |
| FR | 1 174 544 | | 3/1959 |
| FR | 2 285 101 | | 4/1976 |
| FR | 2 564 712 | | 11/1985 |
| FR | 2 567 006 | | 1/1986 |
| FR | 2 701 198 | | 6/1994 |
| FR | 2 749 490 | | 12/1997 |
| FR | 2 754 450 | | 4/1998 |
| FR | 2 798 267 | | 3/2001 |
| FR | 2 799 939 | | 4/2001 |
| GB | 28813 | | 0/1907 |
| GB | 452640 | | 8/1936 |
| GB | 683932 | | 12/1952 |
| GB | 918901 | | 2/1963 |
| GB | 1 459 859 | | 12/1976 |
| GB | 2 243 762 | A | 11/1991 |
| JP | 55-5606 | | 1/1980 |
| JP | 55-76612 | | 6/1980 |
| JP | 55-136409 | | 9/1980 |
| JP | U-59-121363 | | 8/1984 |
| JP | 60-18722 | | 2/1985 |
| JP | 62-2631 | | 1/1987 |
| JP | 2-147074 | | 6/1990 |
| JP | 9-125 | | 3/1997 |
| JP | A-10-151023 | | 6/1998 |
| JP | A-10-327929 | | 12/1998 |
| WO | WO 82/02326 | | 7/1982 |
| WO | WO 88/02608 | | 4/1988 |
| WO | WO 91/01097 | | 2/1991 |
| WO | WO 92/11785 | | 7/1992 |
| WO | WO 96/04816 | | 2/1996 |
| WO | WO 96/32033 | | 10/1996 |
| WO | WO 97/07705 | | 3/1997 |
| WO | WO 97/09905 | | 3/1997 |
| WO | WO 97/31553 | | 9/1997 |

OTHER PUBLICATIONS

EPO Communication dated Jan. 7, 2005.

Opposition Brief w/English Translation in Corresponding EPO Patent No. 1 053 695 B1.

* cited by examiner

DEVICE FOR PACKAGING AND APPLYING A COSMETIC, IN PARTICULAR FOR MAKING UP THE LIPS

The present invention relates to a device for packaging and applying a cosmetic, the device comprising a receptacle for containing said cosmetic, an applicator having a rod fitted at one end with an applicator element, and a wiper member for wiping the applicator element while the applicator is being extracted from the receptacle.

BACKGROUND OF THE INVENTION

Numerous packaging and applicator devices of this type are known.

In order to make it easier to apply the cosmetic, certain applicators have an applicator element which makes an angle with the axis of the rod.

Thus, U.S. Pat. No. 4,165,755 proposes a packaging and applicator device for mascara in which the rod of the applicator has a hinged portion at its distal end with the applicator element being secured thereto.

In use, the applicator is extracted partially from the receptacle until the hinge of the rod has cleared the neck of the receptacle.

Thereafter, while the applicator element is still engaged in the neck, the rod is tilted so as to incline the applicator element and position it in the desired configuration.

Such an applicator is relatively complex to manufacture.

Curved applicator elements are also known for applying mascara to the eyelashes.

It has been observed that such applicator elements are not always wiped in entirely satisfactory manner and that sometimes a quantity of makeup that is deemed to be excessive remains in the concave side of the applicator element.

Finally, there exists a need to have an applicator making it possible to apply makeup, particularly on the lips, with intensities that differ depending on the desired result.

OBJECTS AND SUMMARY OF THE INVENTION

The present invention seeks to propose a novel packaging and applicator device which is of relatively simple structure, which is ergonomic, and which makes it possible to apply makeup neatly.

The packaging and applicator device of the invention is of the type comprising a packaging and applicator device comprising a receptacle for containing the substance to be applied, an applicator comprising a rod provided at one end with an applicator element, and a wiper member for wiping the rod and the applicator element while the applicator is being extracted from the receptacle, and the applicator element forms an angle with the rod and has an elastically deformable body and/or core capable of deforming elastically to pass through the wiper member while the applicator is being withdrawn, the wiper member deforming substantially less than the applicator element while the applicator element is passing through the wiper member.

By means of the invention, the applicator element can be made with an ergonomic configuration that facilitates the operation of applying makeup without there being any need, as is the case in above-mentioned U.S. Pat. No. 4,165,755 for example, to provide a hinge on the rod so as to allow the applicator element to pass through the wiper member.

In other words, the applicator element can present the same configuration in the storage position within the receptacle as it does in use, and it can pass easily through the wiper member while the applicator is being withdrawn.

The applicator can be withdrawn on the axis of the receptacle since the applicator element deforms elastically to pass through the wiper member.

By means of the invention, it becomes possible to provide an applicator element presenting a shape that is well adapted to the kind of make up operation to be performed.

Furthermore, given the angle formed with the rod, the applicator element bears against the wiper member more strongly in at least one location, thereby giving rise to a non-uniform distribution of the makeup over its surface.

It is possible to take advantage of this non-uniform distribution of the makeup on the surface of the applicator element to provide one or more supplies of makeup, thereby enabling the operation of applying the makeup to be facilitated.

Thus, the applicator element can be wiped so that one side carries more makeup than the other.

The user can make use of the side carrying more makeup to outline the lips, for example, and can make use of the other side, which has been wiped more strongly and which carries less makeup, to apply the makeup over larger areas with the intensity of the makeup being smaller.

The user can also apply the makeup on one lip at an intensity that is different from that on the other lip.

Finally, the non-uniform wiping of the applicator element can advantageously be put to advantage to remedy the defects of curved applicators, in particular of mascara, by reducing the quantity of makeup left in the concave side of the applicator element.

The applicator element may include an end portion that is conical or flat.

When the end portion is flat, it may have one or two outwardly convex main faces.

In a particular embodiment, the end portion may be flat perpendicularly to a plane containing the axis of the rod and the axis of the end portion.

The end portion may have lateral edges that are outwardly convex.

The end portion may also have be flat parallel to the plane containing the axis of the rod and that of the applicator element.

The applicator element may have one or more recesses.

The applicator element may have flocking on its surface.

The body of the applicator element can be made of an elastomer material.

The applicator element can be symmetrical in shape about a plane of symmetry containing the axis of the rod.

The applicator element may also be non-circularly symmetrical in shape about the axis of the rod.

The applicator element can be constituted by a mascara brush, whose core is elastically deformable.

The core can be surrounded by a covering such as flocking, a foam, or a woven or non-woven fabric, the flexibility of the covering being different from that of the material constituting the core, the covering preferably being softer than the core.

The applicator element may have an elastically deformable body and serve to apply makeup on the lips.

The wiper member is preferably substantially non-deformable and in a particular embodiment it is made out of a rigid or semi-rigid plastics material.

In a particular embodiment, the applicator element is arranged to deform more easily in bending than in straightening.

Thus, for example when the applicator element is in the form of a bend, the applicator element can bend easily during application, thereby making it comfortable to use, while it deforms with greater difficulty while straightening on passing through the wiper member, thereby obtaining non-uniform distribution of the makeup over its surface.

In a particular embodiment, the applicator element is integrally molded with the rod.

Still in a particular embodiment, the rod has at least one portion of diameter that is smaller than the largest diameter of the applicator element.

Still in a particular embodiment, the elasticity of the body and/or the web of the applicator element varies as a function of position considered along the applicator element.

It is thus possible to have an applicator element with one or more zones that are wiped more or less strongly after it has passed through the wiper member.

In a particular embodiment, the end of the applicator element is more flexible than an intermediate portion or a portion whereby it is connected to the rod, thereby favoring comfort in use.

In a particular embodiment, the applicator element is constituted by a mascara brush made by injection molding and having a core that is elastically deformable.

In another particular embodiment, the applicator element is constituted by a comb for applying makeup on the eyelashes or the eyebrows, the comb being made of an elastomer and having an elongate body of curved shape, presenting an outwardly convex longitudinal face connected to at least one row of teeth, said face forming an angle relative to the axis of the applicator rod that increases with increasing distance away from the rod.

Advantageously, the comb has shaped front and rear portions to facilitate passing the comb through the wiper member.

On its side opposite from the teeth, the comb may have at least one groove.

The comb may have at least one row of teeth whose profile is triangular when the comb is seen from the side, with the bases of the teeth being close but non-touching, and may have another row of teeth on at least one side of said row.

The invention also provides the use of a device as defined above for making up the lips, the eyelashes, or the eyebrows, the applicator element being adapted to each of those uses.

BRIEF DESCRIPTION OF THE DRAWINGS

Other characteristics and advantages of the present invention will appear on reading the following detailed description of non-limiting embodiments of the invention, and on examining the accompanying drawings, in which.

MORE DETAILED DESCRIPTION

Figure 1:
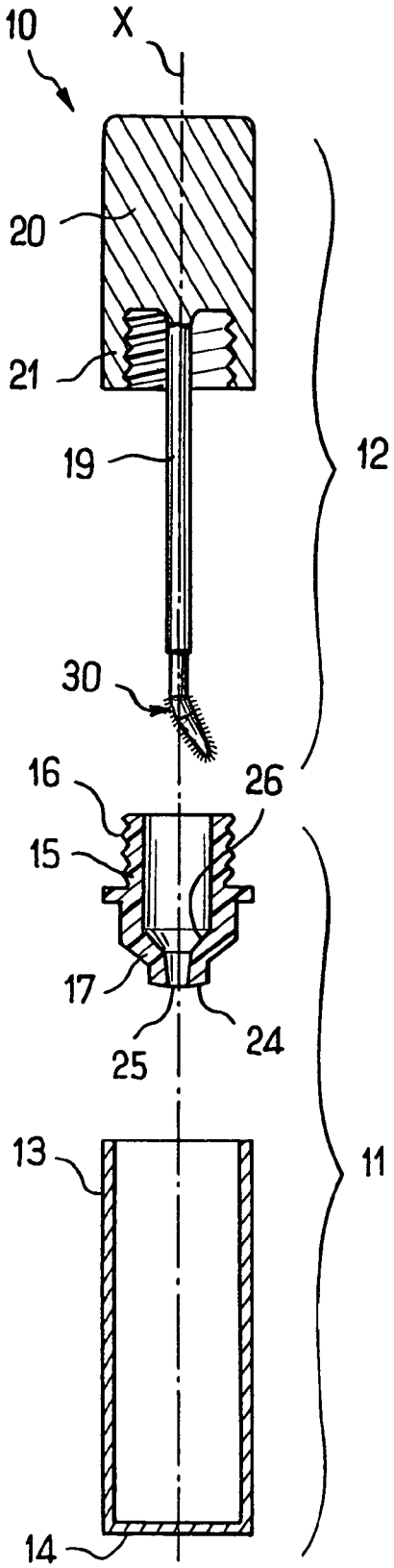
FIG. 1 is a diagrammatic exploded view in axial section of a packaging and applicator device constituting a first embodiment of the invention.
Figure 2:
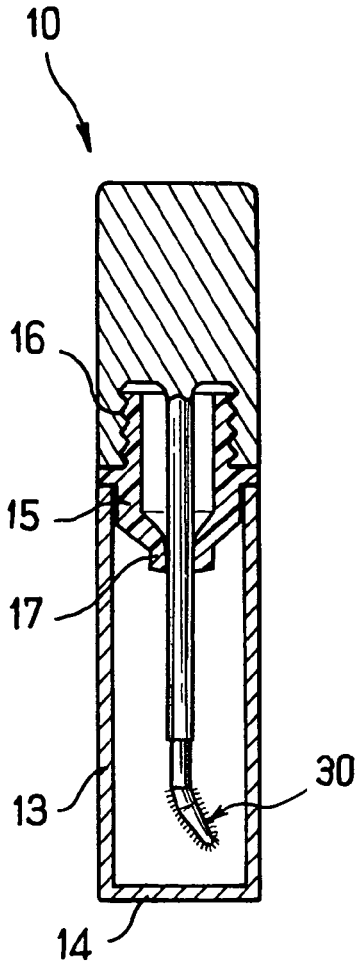
FIG. 2 shows the FIG. 1 device when the applicator is in place inside the receptacle.

The packaging and applicator device 10 shown in FIGS. 1 to 4 comprises a receptacle 11 and an applicator 12.

The receptacle 11 has a circularly cylindrical body 13 about an axis X, that is closed at its bottom end by a bottom wall 14 and open at its top end to receive an endpiece 15.

The top portion of the endpiece 15 constitutes the neck 16 of the receptacle, and the bottom portion thereof serves as a wiper member 17.

The applicator 12 had a rod 19 which in the example described is rectilinear along the axis X, the rod being provided at its top end with a handle member 20 and at its bottom end with an applicator element 30.

The handle member 20 has an internally threaded skirt 21 enabling it to be screwed onto the neck 16 of the receptacle 11.

In the example described, the rod 19 is circular in section.

The wiper member 17 is constituted by an annular lip that is circularly symmetrical about the axis X, with the inside edge of its bottom end 24 defining a circular orifice 25 of diameter substantially equal to the diameter of the rod 19 so as to wipe the rod while the applicator 12 is being withdrawn from the receptacle, as described in greater detail below.

The inside surface of the annular lip 17 immediately below the orifice 25 is slightly conical.

The annular lip 17 advantageously forms an insertion cone 26 designed to facilitate inserting the applicator into the receptacle.

In the example described, the annular lip 17 is made of a rigid plastics material and does not deform significantly while the applicator is being withdrawn.

Figure 5:
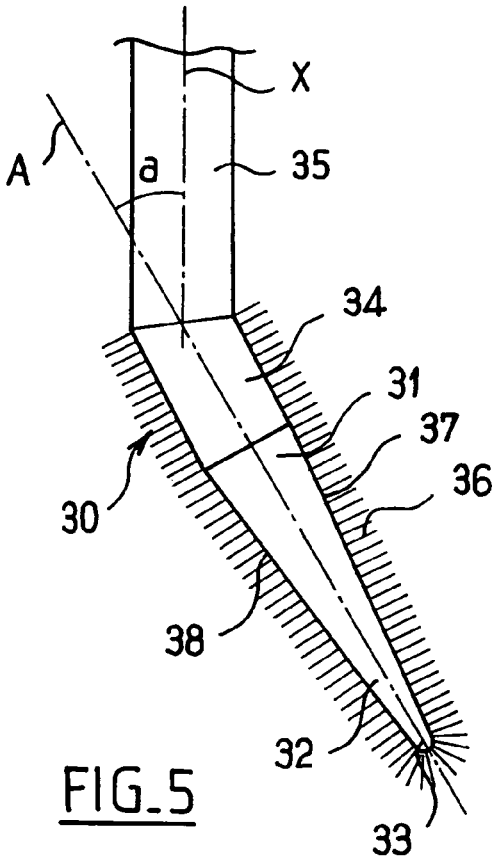
FIG. 5 shows the applicator element in isolation and on a larger scale prior to first mounting in the receptacle.

FIG. 5 shows the applicator element 30 in isolation, which element comprises a body 31 made of an elastomer material, e.g. by molding.

In the example described, the body 31 has a conical end portion 32 on an axis A that terminates in a rounded tip 33.

The end portion 32 is connected via a cylindrical intermediate portion 34 to a fixing portion 35 of axis X.

The end and intermediate portions 32 and 34 are covered in flocking 36 that is softer than the body 31, thereby improving retention of the makeup and comfort in use.

The fixing and intermediate portions 35 and 34 are of the same outside diameter which is slightly smaller than that of the rod 19.

The term "inner" side 37 is used below to designate that side of the applicator element 30 which is situated on the concave side of the bend formed by the axes A and X, and the term "outer" side 38 is used to designate the opposite side.

Figure 3:
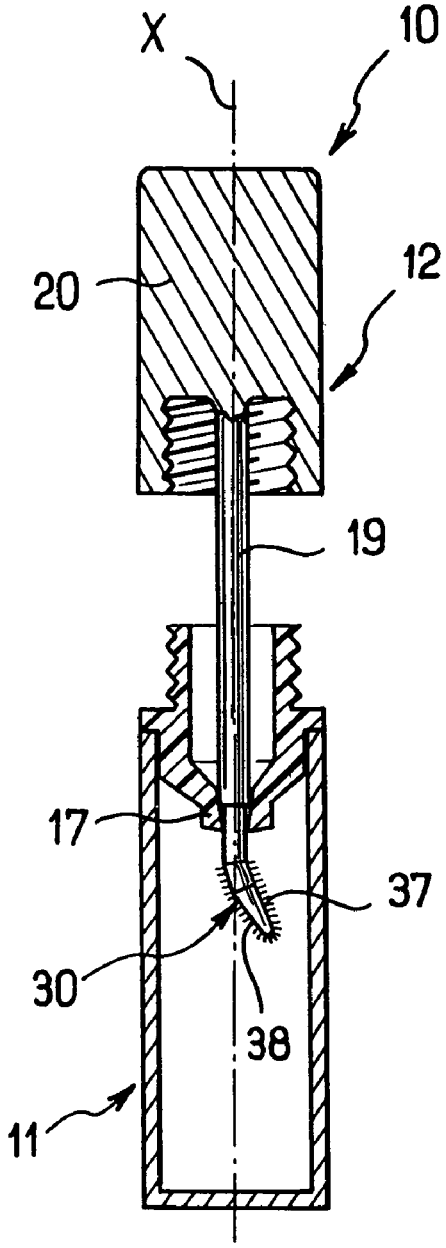
FIG. 3 shows the FIG. 1 applicator while it is being withdrawn from the receptacle.

While the applicator 12 is being withdrawn from the receptacle 11 with the rod 19 lying substantially on the axis X of the receptacle, the wiper lip 17 begins by wiping the rod 19, as shown in FIG. 3.

Figure 4:
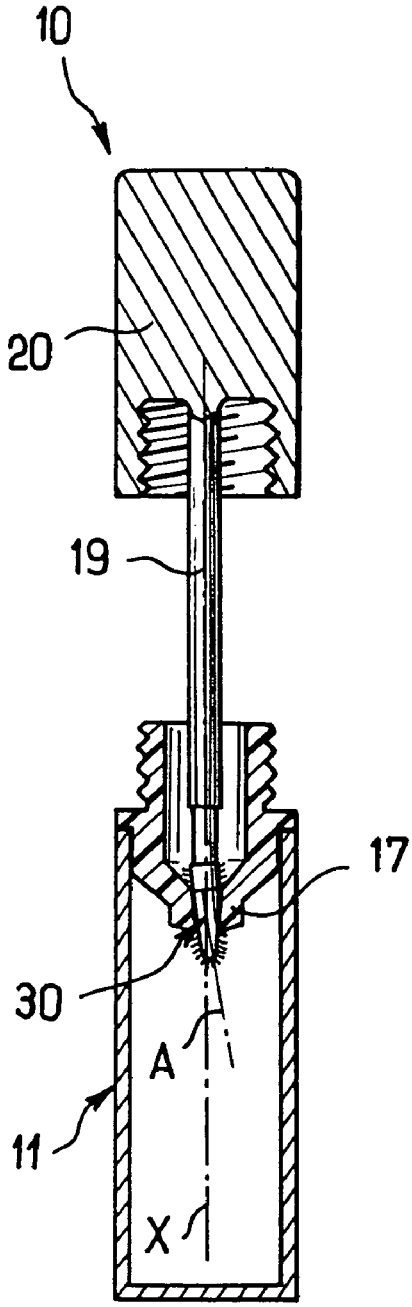
FIG. 4 shows the FIG. 1 device with the applicator element passing through the wiper member.

Thereafter, the wiper lip 17 wipes the applicator element 30 which, because of the body 31 being made of an elastically deformable material, is suitable for straightening out as it passes through the wiper lip 17, as shown in FIG. 4.

While the applicator element 30 is passing through the wiper lip 17, the non-zero angle a formed between the axis A of the end portion 32 and the axis X of the receptacle decreases.

The angle a can be greater than 25°, 35°, 45°, or even more.

Furthermore, it will be understood that the applicator element 30 which tends under its own elasticity to return to its initial configuration, presses more strongly against the wiper lip 17 on the inner side 37 than on the outer side 38.

Figure 6:
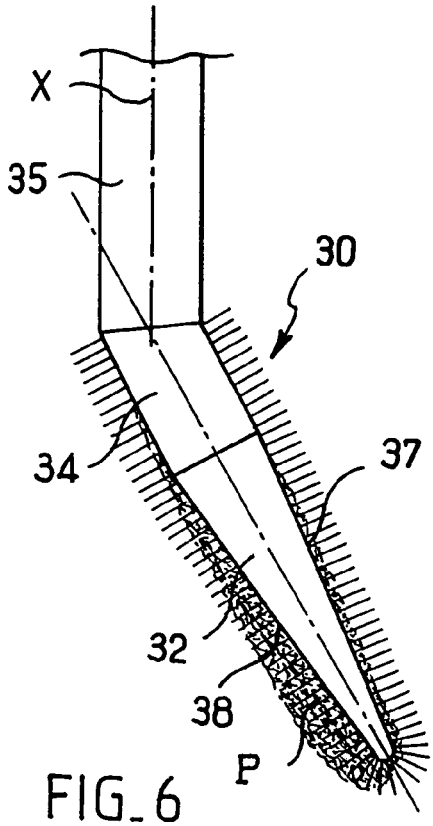
FIG. 6 shows the FIG. 5 applicator element on the larger scale after it has been wiped.

As a result, the applicator element 30 is wiped more strongly on the inner side 37 than on the opposite side, and a greater thickness of makeup P thus remains on the outer side 38 once the applicator has been fully extracted from the receptacle, as shown in FIG. 6.

While applying makeup, advantage can be taken of this greater thickness of makeup on the outer side 38 in order to draw the outline of the lips, for example.

Figure 7:
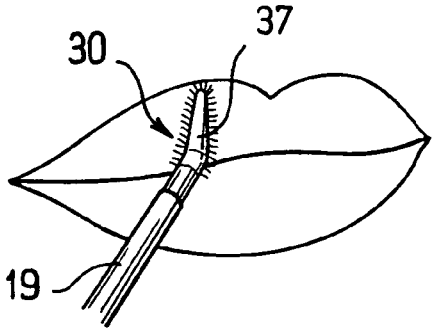
FIGS. 7 and 8 show how the applicator is used for making up the lips.
Figure 8:
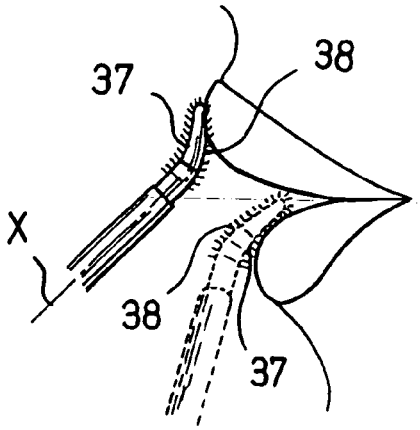

As shown in FIG. 7 and in continuous lines in FIG. 8, the applicator can be used by being moved over the top lip with the outer side 38 in contact therewith.

Because of the greater thickness of makeup on the outer side 38, the makeup is intense.

To make up the lower lip, the user can use the outer side 38 or the inner side 37 as shown in discontinuous lines in FIG. 8.

Because of the smaller thickness of makeup on the surface of the inner side 37, the inner side is used to obtain makeup that is less intense.

The invention thus makes it possible to act on the intensity of making up by selecting the inner side 37 or the outer side 38.

The user can thus draw the outline of the lip using the outer side 38 and then cover one or the other lip or both lips using the outer side or the inner side, depending on the intended effect.

The user can also make up one of the lips using the inner side 37 and the other lip with the outer side 38.

In the example described, given the tapering shape of the applicator element, the end thereof deforms more easily than does the region of the applicator element which forms a bend with the rod.

The applicator element thus deforms more easily in bending than in straightening.

Figure 9:
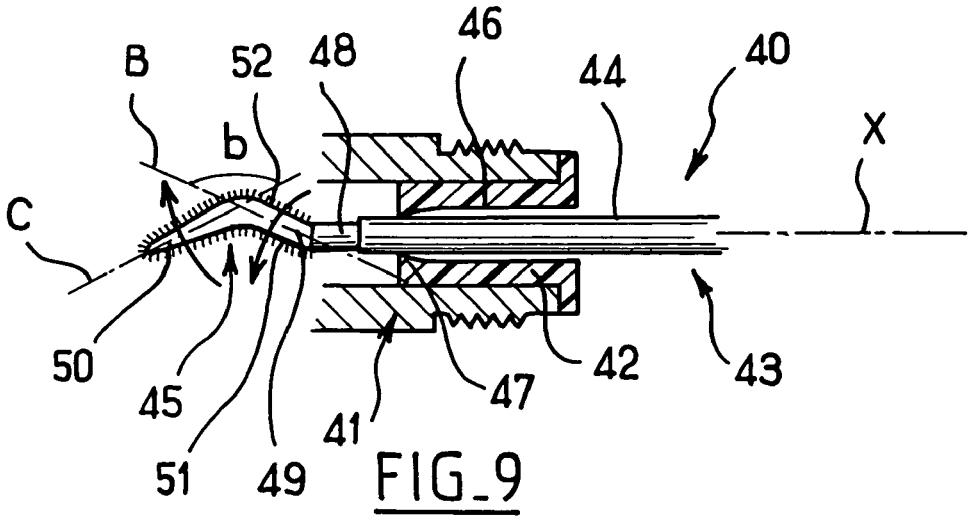
FIGS. 9 to 11 show an applicator element in a second embodiment of the invention during various steps while the applicator is being withdrawn from the receptacle.
Figure 10:
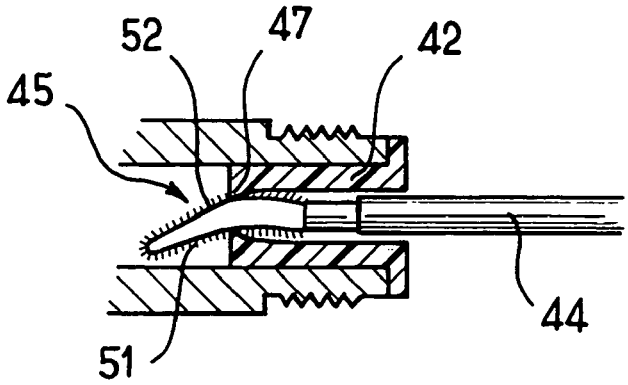
Figure 11:
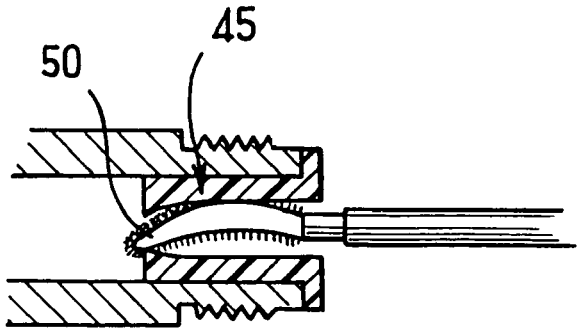
Figure 14:
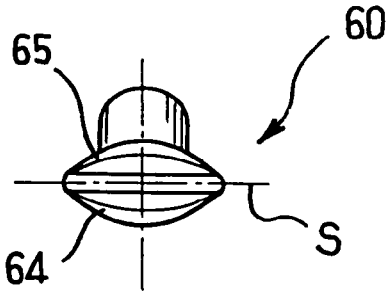
FIG. 14 is a view of FIG. 13 seen from beneath along arrow XIV.
Figure 13:
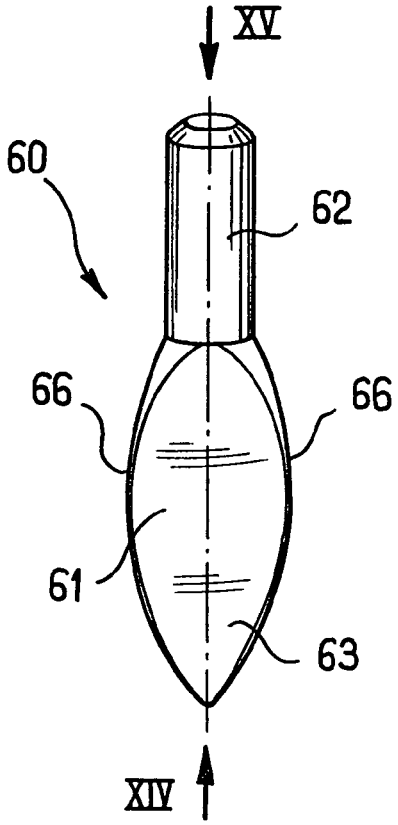
FIG. 13 is a side view of FIG. 12 seen along arrow XIII.

FIGS. 9 to 11 show part of a packaging and applicator device 40 constituting a second embodiment of the invention.

This device comprises a receptacle 41 which is shown in part only, the opening of the receptacle being provided with a wiper member 42, and an applicator 43 having a rod 44 fitted at its distal end with an applicator element 45.

The wiper member 42 has an inside surface 46 that is slightly conical, converging towards the inside of the receptacle, and its bottom edge defines a circular orifice 47 of a diameter suitable for wiping the rod 44.

The applicator element 45 has a body made of an elastically deformable material and covered in flocking.

The body of the applicator element has a fixing portion 48 secured to the rod 44, an intermediate portion 49 of axis B at an angle with the axis X of the rod, and a tapering end portion 50 of axis C making an angle b with the axis B of the intermediate portion 49.

The intermediate and end portions 49 and 50 give the applicator element 45 a curved shape with an inner side 51 that is concave towards the outside and towards the axis X, and an outer side 52 that is convex towards the outside, as shown in FIG. 9.

While the applicator is being withdrawn from the receptacle, the applicator element 45 is suitable for straightening out so as to pass through the orifice 47 of the wiper member 42.

The intermediate portion 49 deforms by moving towards the axis X, and the end portion 50 tends to pivot outwards, as shown by the arrows in FIG. 9.

On examining FIG. 10, it will be observed that the edge defining the orifice 47 of the wiper member 42 tends to scrape the outer side of the intermediate portion 49 and the inner side of the end portion 50 of the concave side of the applicator element 45 does not have excess makeup while a greater thickness of makeup is left on the outer side 52 of the end portion 50.

This greater thickness of makeup can be used to draw an outline, as described above.

FIGS. 12 to 15 show an applicator element 60 in a third embodiment of the invention.

This applicator element 60 comprises a body 61 made of an elastically deformable material.

The body 61 has a fixing portion 62 on the axis X for securing to the rod of the applicator, and an end portion 63 of axis A making an angle with the axis X.

The end portion 63 is flat in a plane S perpendicular to the plane defined by the axes A and X and has two opposite main faces 64 and 65 that are outwardly convex, and that are laterally defined by rounded edges 66.

On passing through the wiper member, the applicator element 60 straightens out, i.e. the angle between the axes A and X decreases.

The end portion 63 of the applicator element is also subjected to lateral compression since the distance between its opposite lateral edges 66 in this examples is greater than the diameter of the orifice of the wiper member.

Like the above-described embodiments, the inner side 68 is wiped more strongly than the outer side 69.

Figure 16:
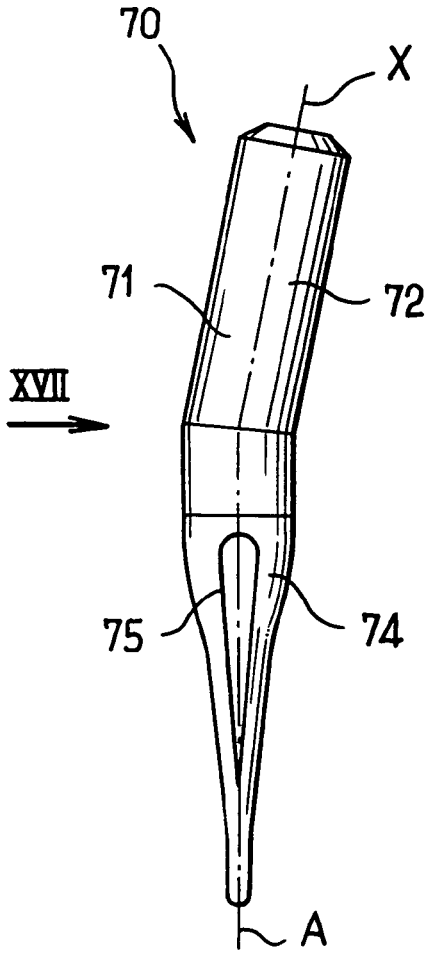
FIG. 16 is a diagrammatic view of an applicator element in a fourth embodiment of the invention.
Figure 17:
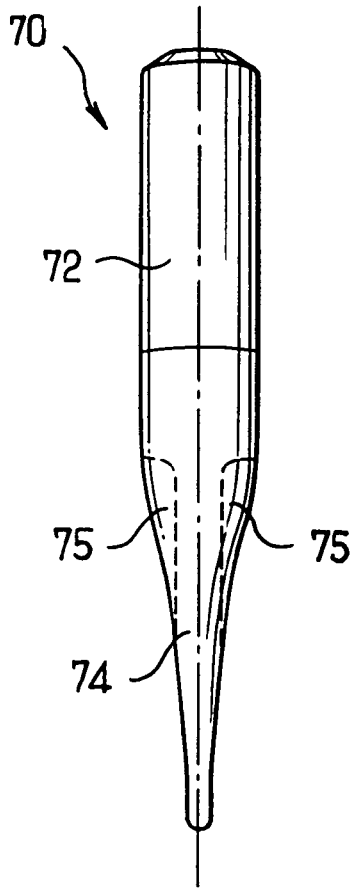
FIG. 17 is a side view of FIG. 16 seen along arrow XVII.

FIGS. 16 and 17 show an applicator element 70 in a fourth embodiment of the invention.

This applicator element 70 has a body 71 made of an elastically deformable material.

The body 71 has a portion 72 for fixing to the rod of the applicator and a generally tapering end portion 74 extending along an axis A that makes an angle with the axis X.

The end portion 74 can have recesses 75 designed to provide reserves of makeup.

Figure 18:
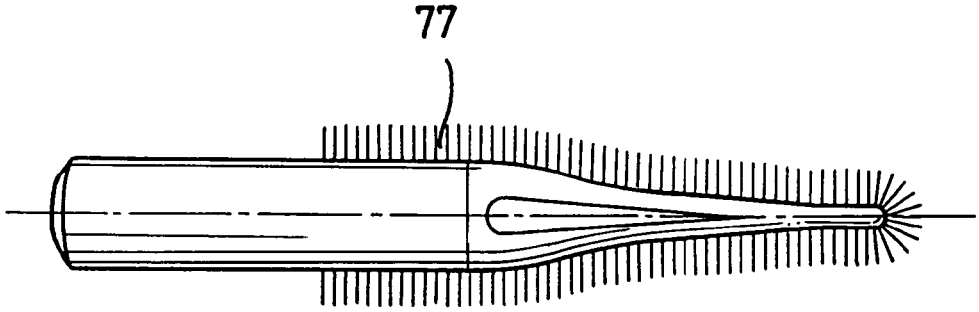
FIG. 18 shows an applicator element in a fifth embodiment of the invention.

The applicator element can have flocking 77, as shown in FIG. 18.

Figure 20:
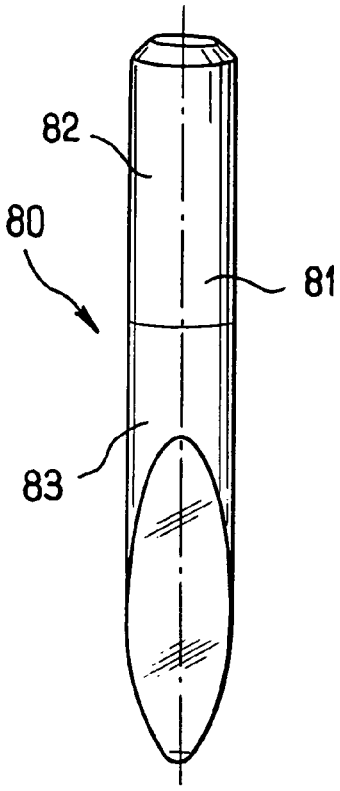
FIG. 20 is a view of FIG. 19 along arrow XX.
Figure 19:
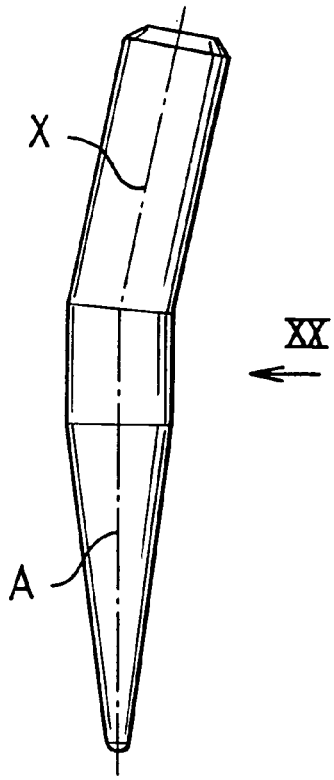
FIG. 19 shows an applicator element in a sixth embodiment of the invention.

FIGS. 19 and 20 show an applicator element 80 in a sixth embodiment of the invention.

This applicator element 80 has a body 81 made of an elastically deformable material, with a portion 82 for fixing to the rod of the applicator and a chamfered end portion 83.

This end portion 83 extends along an axis A making a non-zero angle with the axis X of the rod, as can be seen in FIG. 19.

Figure 21:
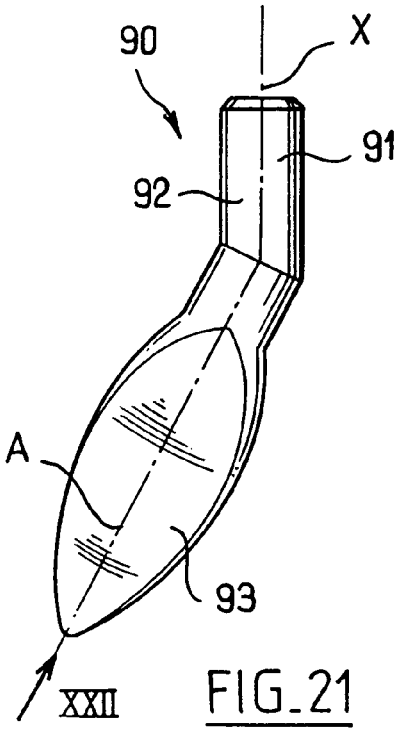
FIG. 21 shows an applicator element in a seventh embodiment of the invention.
Figure 22:
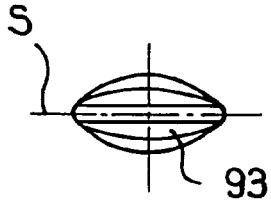
FIG. 22 is a fragmentary view of FIG. 21 seen along arrow XXII.

FIGS. 21 and 22 show an applicator element 90 in a seventh embodiment of the invention, comprising a body 91 made of an elastically deformable material, said body 91 having a portion 92 for fixing to the rod of the applicator, and an end portion 93 of axis A.

Figure 12:
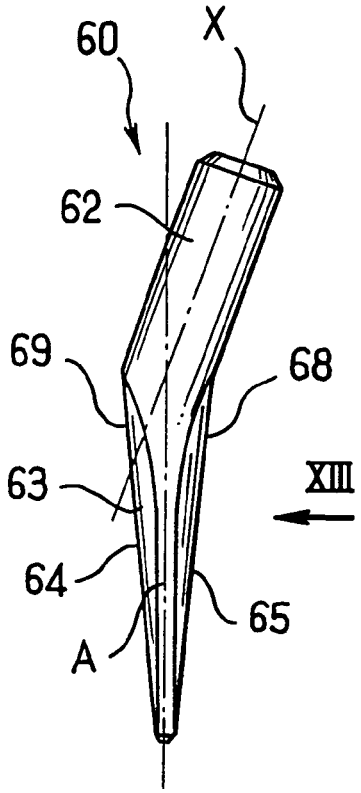
FIG. 12 shows an applicator element in a third embodiment of the invention.
Figure 15:
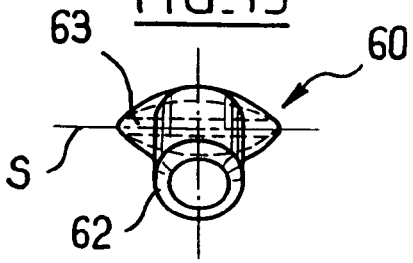
FIG. 15 is a view of FIG. 13 seen from above along arrow XV.

This end portion 93 is identical to the end portion 63 described above except that the plane S in which it is flat is no longer perpendicular to the plane defined by the axes A and X as in the embodiment of FIG. 12, but lies in said plane.

Figure 23:
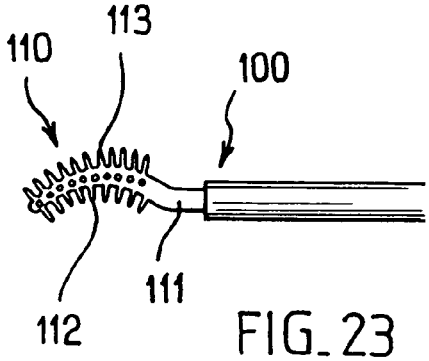
FIG. 23 shows an applicator element in an eighth embodiment of the invention.

FIG. 23 shows a portion of an applicator 100 having an applicator element 110 constituted by a mascara brush made by injecting plastics material, with the core 111 thereof being elastically deformable and taking up a curved shape at rest.

The brush 110 is wiped in its end portion more strongly on its inner side 112 than on its outer side 113.

This reduces the quantity of makeup on the concave side of the core 111.

Figure 24:
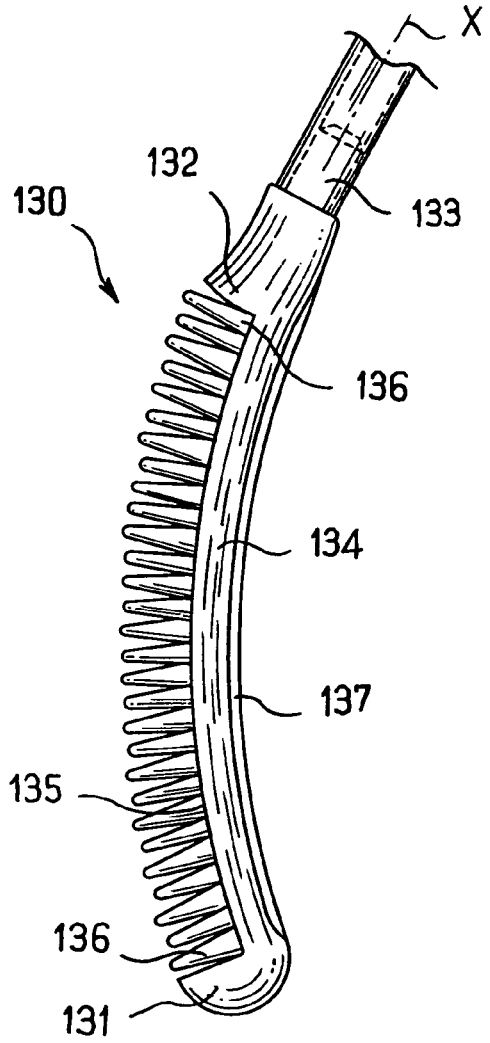
FIG. 24 shows an applicator element in a ninth embodiment of the invention.

FIG. 24 shows an applicator element 130 in a ninth embodiment of the invention, formed integrally out of an elastomer by injection molding.

This applicator element 130 constitutes a comb for application on the eyelashes or the eyebrows.

The comb 130 has an endpiece 133 of axis X enabling it to be fixed to the free end of the applicator rod.

The endpiece 133 is connected to an elongate body 134 curving about an axis perpendicular to the axis X and having a midplane of symmetry for the body 134, said midplane being parallel to the plane of FIG. 24.

The body 134 has front and rear portions 131 and 132 which are shaped so as to make the comb easier to pass through the wiper member.

The body 134 has a convex longitudinal face 135 on which there is a row of teeth 136.

The front and rear portions 131 and 132 extend over substantially the same height as the teeth 136.

On its side opposite from the teeth 136, the body 134 has a longitudinal groove 137.

When the comb is observed from the side, as is the case in FIG. 24, pairs of consecutive teeth 136 form V-shaped notches.

Because of the curved shape of the comb, the eyelashes can easily engage between the teeth 136.

During wiping, the comb 130 straightens out; the makeup contained between the teeth 136 is expelled, in particular to the sides.

Some makeup is left in the groove 137 so as to constitute a reserve during application, it being possible to bring the eyelashes into contact with the back of the comb 130.

Figure 25:
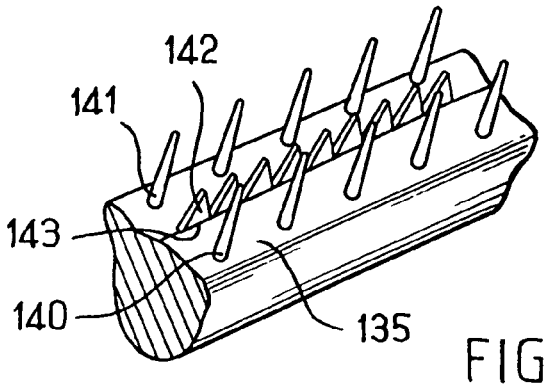
FIG. 25 shows an arrangement of projecting elements on one face of the applicator element.

The row of teeth 136 can be replaced by teeth having other configurations, for example that shown in FIG. 25.

This figure shows three rows of teeth 140, 141, and 142 which are connected, for example, to the convex face 135 of the comb 130 to replace the teeth 136.

The teeth 140 and 141 are identical in shape and are disposed on either side of the teeth 142.

When seen from the side, these teeth are triangular in profile, having bases 143 that do not touch.

Naturally, the invention is not limited to the embodiments described above.

In particular, the shape of the applicator element and the shape of the wiper member can be modified without going beyond the ambit of the present invention.

It is thus possible to make other applicator elements having ergonomic shapes.

The applicator rod is not necessarily rectilinear, it could be curved.

In which case, it should be understood that the axis with which the applicator element makes an angle is the axis of the portion of the rod adjacent to the applicator element.

The invention claimed is:

1. A device comprising:

a receptacle for containing a substance to be applied, an applicator comprising a rod having a longitudinal axis, provided at one end with an applicator element, and a wiper member for wiping the applicator element while the applicator is being extracted from the receptacle, wherein:

the applicator element comprises a body carrying along its entire length at least one application member, said body having a longitudinal axis making a non-zero angle with the longitudinal axis of the rod, said body being along said length elastically deformable so that said body is capable of deforming elastically to pass through the wiper member while the applicator is being withdrawn, the wiper member having substantially less deformation, if any, than the body of the applicator element while the applicator element is passing through the wiper member, and the applicator element and wiper are configured to provide a non-uniform distribution of the substance on the surface of the applicator element.

2. A device according to claim 1, wherein the wiper member is substantially non-deformable.

3. A device according to claim 2, wherein the wiper member is made of one of a rigid and semi-rigid plastics material.

4. A device according to claim 1, wherein the applicator element has a conical end portion.

5. A device according to claim 1, wherein the applicator element has a flat end portion.

6. A device according to claim 5, wherein said end portion has one or two main faces that are outwardly convex.

7. A device according to claim 5, wherein said flat end portion is flat perpendicularly to a plane containing an axis of the rod and an axis of the end portion.

8. A device according to claim 5, wherein said flat end portion is flat parallel to a plane containing an axis of the end portion and an axis of the rod.

9. A device according to claim 5, wherein the end portion has lateral edges that are outwardly convex.

10. A device according to claim 9, wherein the applicator element has a surface and a flocking on said surface.

11. A device according to claim 1, wherein the body of said applicator element has at least one recess.

12. A device according to claim 11, wherein the applicator element has a surface and a flocking on said surface.

13. A device according to claim 1, wherein the applicator element has a surface and a flocking on said surface.

14. A device according to claim 1, wherein said body is made of elastomeric material.

15. A device according to claim 14, wherein the applicator element has a surface and a flocking on said surface.

16. A device according to claim 1, wherein the body is surrounded by a covering, and wherein said covering is softer than the body.

17. A device according to claim 1, wherein the applicator element is integrally molded with the rod.

18. A device according to claim 1, wherein the rod has at least one portion with a diameter that is smaller than a largest diameter of the applicator element.

19. A device according to claim 1, wherein the body has an elasticity and the elasticity of the body varies as a function of the position along the applicator element.

20. A device according to claim 19, wherein an end portion of the body is more flexible than an intermediate portion of the body located between said end portion and said rod.

21. A device according to claim 1, wherein the applicator element is symmetrical in shape about a plane containing an axis of the rod.

22. A device according to claim 1, wherein the applicator element is not circularly symmetrical in shape about an axis of the rod.

23. A device according to claim 1, wherein the applicator element is made by injection molding.

24. A device according to claim 1, wherein the applicator element is a comb made of elastomer for applying makeup to the eyelashes or the eyebrows.

25. A device according to claim 24, wherein the comb has front and rear portions that are shaped to facilitate passing the comb through the wiper member.

26. A device according to claim 24, wherein said comb has at least one groove on a side opposite from teeth.

27. A device according to claim 24, wherein the comb has at least one row of teeth each of triangular profile when the comb is observed from a side.

28. A device according to claim 27, wherein the comb has at least another row of teeth on at least one side of said row.

29. A device according to claim 24, wherein said comb has at least one row of teeth connected to a convex longitudinal face of said body.

30. A device according to claim 24, wherein the comb has at least two rows of teeth on opposite sides of said comb.

31. A device according to claim 1, wherein said applicator element is configured along said entire length for applying a substance to a user.

32. A device according to claim 1, wherein said applicator element is a comb having a convex side and a concave side opposite said convex side, said convex and concave sides carrying teeth.

33. A device according to claim 1, wherein said applicator element is a comb having at least two rows of teeth on opposite sides of said comb, one of said rows of teeth having teeth with free ends arranged along a generally convex line and another one of said rows having teeth with free ends arranged along a generally concave line.

34. A device according to claim 1, wherein said application member is selected from the group consisting of bristles, teeth, and a covering softer than the body.

35. A device according to claim 1, wherein said wiper member is arranged for wiping said rod.

36. A device according to claim 35, wherein said wiper member has a circular orifice, said rod is of circular cross-section, and a diameter of said circular orifice is substantially equal to a diameter of said rod.

37. A device according to claim 1, wherein said body has a chamfered end portion extending along an axis making a non-zero angle with an axis of said rod, said angle varying as the applicator element passes through said wiper member.

38. A device according to claim 1, wherein said body has a cylindrical portion for fixing into a recess at one end of said rod.

39. A device according to claim 1, wherein the wiper member has substantially less deformation, if any, than the body of the applicator element while the applicator element is passing through the wiper member, so that the applicator element becomes straighter.

40. A device according to claim 1, wherein the wiper member is made of rigid plastics material.

41. A device comprising:

a receptacle for containing a substance to be applied;

an applicator comprising a rod having a longitudinal axis and provided at one end with an applicator element; and a wiper member for wiping the rod and the applicator element while the applicator is being extracted from the receptacle, wherein the applicator element comprises a body carrying along its entire length at least one application member, said body having a longitudinal axis forming a non-zero angle with the longitudinal axis of the rod, and said body being along said length elastically deformable so that said angle varies to pass through the wiper member while the applicator is being withdrawn, and the applicator element and wiper member are configured to provide a non-uniform distribution of the substance on the surface of the applicator element.

42. A device according to claim 41, wherein said body has a surface and flocking on said surface.

43. A device according to claim 41, wherein said wiper member is made of one of rigid and semi-rigid plastics material.

44. A device according to claim 41, wherein the wiper member is substantially non-deformable.

45. A device according to claim 41, wherein the applicator element has a conical end portion.

46. A device according to claim 41, wherein the applicator element has a flat end portion.

47. A device according to claim 41, wherein said flat end portion has one or two main faces that are outwardly convex.

48. A device according to claim 41, wherein said flat end portion is flat perpendicularly to a plane containing an axis of the rod and an axis of the end portion.

49. A device according to claim 41, wherein said flat end portion is flat parallel to a plane containing an axis of the end portion and an axis of the rod.

50. A device according to claim 41, wherein said flat end portion has lateral edges that are outwardly convex.

51. A device according to claim 41, wherein the body of said applicator element has at least one recess.

52. A device comprising:

a receptacle for containing a substance to be applied on the eyelashes or eyebrows;

an applicator comprising a rod and provided at one end with an elastically deformable comb; and a wiper member for wiping the comb while the applicator is being extracted from the receptacle, wherein the comb has an axis that forms a non-zero angle with the rod, a portion of said comb carrying teeth along its entire length and being elastically deformable to pass through the wiper member while the applicator is being withdrawn, and the applicator element and wiper member are configured to provide a non-uniform distribution of the substance on the comb.

53. A device according to claim 52, wherein the wiper member has substantially less deformation, if any, than the comb while the comb is passing through the wiper member.

54. A device according to claim 52, wherein said comb is made of an elastomer.

55. A method of applying a product to eyebrows or eyelashes with a device, the device comprising a receptacle and an applicator comprising a rod provided at one end with an applicator element, said receptacle comprising a wiper member for wiping the applicator element while the applicator is being extracted from the receptacle, wherein said method comprises:

charging said applicator element with product inside said receptacle while having said applicator element make a non-zero angle with said rod;

wiping said applicator element using said wiper member and changing said angle during the wiping action of said applicator element so as to provide a non-uniform distribution of the substance on the surface of the applicator element, and applying product on said eyebrows or said eyelashes, wherein said applicator element comprises a body carrying along its entire length at least one application member, said body being along said length elastically deformable.

56. A device comprising:

a receptacle for containing a substance to be applied;

an applicator comprising an applicator element, said applicator having a longitudinal axis; and a wiper member for wiping the applicator element while the applicator is being extracted from the receptacle, wherein the applicator element has a body carrying along its entire length at least one application member, said body including a portion that forms an angle with the longitudinal axis, said body being along said length elastically deformable so that said angle varies as the portion passes through the wiper member while the applicator is being withdrawn, and the applicator element and wiper member are configured to provide a non-uniform distribution of the substance on the surface of the applicator element.

57. A device according to claim 56, wherein a surface of said applicator element has flocking on said surface.

58. A device according to claim 56, wherein said wiper member is made of one of rigid and semi-rigid plastics material.

59. A device according to claim 56, wherein the wiper member is substantially non-deformable.

60. A device according to claim 56, wherein the applicator comprises a rod having the applicator element at one end, said rod not being deformed while said applicator is being withdrawn.

61. A device comprising:

a receptacle for containing a substance to be applied;

an applicator comprising an applicator element, said applicator having a longitudinal axis; and a wiper member for wiping the applicator element while the applicator is being extracted from the receptacle, wherein the applicator element comprises a body carrying along its entire length at least one application member or defining along its entire length an application surface extending up to a free end of said body, said body having along said length a curved shape, and said body being along said length elastically deformable so that said curved shape changes as the body passes through the wiper member while the applicator is being withdrawn, and the applicator element and wiper member are configured to provide a non-uniform distribution of the substance on the surface of the applicator element.

62. A device according to claim 61, wherein said body includes a first end and a second end opposite to the first end, a distance between the body and the longitudinal axis increases from the first end to the second end, and the distance between the second end and the longitudinal axis varies as the body passes through the wiper member while the applicator is being withdrawn.

63. A device according to claim 61, wherein the applicator element is a comb.

64. A device according to claim 61, wherein said wiper member is made of one of rigid and semi-rigid plastics material.

65. A device according to claim 61, wherein the wiper member is substantially non-deformable.

66. A device according to claim 61, wherein the applicator comprises a rod having the applicator element at one end, said rod not being deformed while said applicator is being withdrawn.

67. A device comprising:

a receptacle for containing a substance to be applied;

an applicator comprising a comb, the applicator having a longitudinal axis; and a wiper member for wiping the comb while the applicator is being extracted from the receptacle, wherein the comb has a curved shape between a first end and a second end opposite to the first end, a portion of said comb carrying teeth along its entire length, said portion of said comb being elastically deformable along its entire length so as to reduce curvature during passage through the wiper member while the applicator is being withdrawn, and the applicator and wiper member are configured to provide a non-uniform distribution of the substance on the surface of the comb.

68. A device according to claim 67, wherein a distance between the longitudinal axis and the second end of the comb decreases while the applicator is being withdrawn.

69. A device according to claim 67, wherein said wiper member is made of one of rigid and semi-rigid plastics material.

70. A device according to claim 67, wherein the wiper member is substantially non-deformable.

71. A device according to claim 67, wherein the applicator comprises a rod having the applicator element at one end, said rod not being deformed while said applicator is being withdrawn.

72. A device comprising:

a receptacle for containing a substance to be applied;

an applicator comprising an elastically deformable applicator element, said applicator having a longitudinal axis, at least a portion of said applicator element being spaced from said longitudinal axis in a non-deformed state of the applicator element; and a wiper member for wiping the applicator element while the applicator is being extracted from the receptacle, said wiper member being substantially non-deformable, wherein a portion of said applicator element carries at least one application member along its entire length or defines along its entire length an application surface extending up to a free end of said portion, wherein said portion elastically deforms along said length so as to become straighter during passage through the wiper member while the applicator is being withdrawn, and the applicator element and wiper member are configured to provide a non-uniform distribution of the substance on the surface of the applicator element.

73. A device according to claim 72, wherein the applicator element comprises a surface and flocking on said surface.

74. A device according to claim 72, wherein the applicator element is a comb having a curved shape in the non-deformed state.

75. A device according to claim 72, wherein said wiper member is made of one of rigid and semi-rigid plastics material.

76. A device according to claim 72, wherein said applicator element comprises a body made of elastomeric material.

77. A device according to claim 72, wherein said body comprises a surface and flocking on said surface.

78. A device according to claim 72, wherein the applicator comprises a rod having the applicator element at one end, said rod not being deformed while said applicator is being withdrawn.

79. A method of applying a product to eyebrows or eyelashes with a device, the device comprising a receptacle and an applicator comprising a comb having an elastically deformable portion carrying teeth along its entire length, said applicator having a longitudinal axis, said comb having a curved shape between a first end and a second end opposite to the first end, a distance between the comb and the longitudinal axis increasing along said curved shape, said receptacle comprising a wiper member for wiping the comb while the applicator is being extracted from the receptacle, wherein said method comprises:

charging said comb with product inside said receptacle while said comb is in a non-deformed state;

wiping said comb using said wiper member, said distance between the comb and the longitudinal axis decreases along said curved shape during the wiping action of said comb so as to provide a non-uniform distribution of the product on the surface of the comb, and applying product from said wiped comb onto said eyebrows or said eyelashes.

80. A device comprising:

a receptacle for containing a substance to be applied;

an applicator comprising an applicator element, said applicator having a longitudinal axis; and a wiper member for wiping the applicator element while the applicator is being extracted from the receptacle, wherein the applicator element comprises a body carrying along its entire length at least one application member or defining along its entire length an application surface extending up to a free end thereof, said body having a curved shape, and said body being along said length elastically deformable so that said curved shape changes more than the shape of the wiper member as the body passes through the wiper member while the applicator is being withdrawn, and the applicator element and wiper member are configured to provide a non-uniform distribution of the substance on the surface of the applicator element.

81. A device according to claim 80, wherein said body includes a first end and a second end opposite to the first end, a distance between the body and the longitudinal axis increases from the first end to the second end, and the distance between the second end and the longitudinal axis varies as the body passes through the wiper member while the applicator is being withdrawn.

82. A device according to claim 80, wherein the applicator element is a comb.

83. A device according to claim 80, wherein said wiper member is made of one of rigid and semi-rigid plastics material.

84. A device according to claim 80, wherein the wiper member is substantially non-deformable.

85. A device according to claim 80, wherein the applicator comprises a rod having the applicator element at one end, said rod not being deformed while said applicator is being withdrawn.

86. A device comprising a receptacle for containing a substance to be applied, an applicator comprising a rod provided at one end with an applicator element, and a wiper member for wiping the applicator element while the applicator is being extracted from the receptacle, wherein the applicator element has an elastically deformable body carrying along its entire length at least one application member selected from the group consisting of teeth and a covering softer than the body, or defining along its entire length an application surface extending up to a free end of said body, said body deforming elastically along said length to pass through the wiper member while the applicator is being withdrawn, the applicator element and wiper member being configured to provide a non-uniform distribution of the substance on the surface of the applicator element, and the wiper member having substantially less deformation, if any, than the body of the applicator element while the applicator element is passing through the wiper member.

87. A device according to claim 86, wherein said covering softer than the body is a flocking.

88. A device comprising:

a receptacle for containing a substance to be applied;

an applicator comprising a rod provided at one end with an applicator element; and a wiper member for wiping the rod and the applicator element while the applicator is being extracted from the receptacle, wherein the applicator element has an elastically deformable body carrying along its entire length at least one application member or defining an application surface along the entire length of said body, said body forming a non-zero angle with the rod, and said body deforming elastically along said length and having said angle vary to pass through the wiper member while the applicator is being withdrawn, and the applicator element and wiper member are configured to provide a non-uniform distribution of the substance on the surface of the applicator element.

89. A device according to claim 88, wherein said at least one application member is a flocking.

90. A device comprising:

a receptacle for containing a substance to be applied;

an applicator comprising a rod provided at one end with an applicator element; and a wiper member for wiping the applicator element while the applicator is being extracted from the receptacle, wherein the applicator element comprises a body defining along its entire length an application surface, said application surface extending up to a free end of said body, said body being along said length elastically deformable so that said body is capable of deforming elastically to pass through the wiper member while the applicator is being withdrawn, the applicator element and wiper member being configured to provide a non-uniform distribution of the substance on the surface of the applicator element, and the wiper member having substantially less deformation, if any, than the body of the applicator element while the applicator element is passing through the wiper member.

91. A device comprising:

a receptacle for containing a substance to be applied;

an applicator comprising an applicator element, said applicator having a longitudinal axis; and a wiper member for wiping the applicator element while the applicator is being extracted from the receptacle, wherein the applicator element comprises a body defining along its entire length an application surface extending up to a free end of said body, said body including a portion that forms an angle with the longitudinal axis, said body being along said length elastically deformable so that said angle varies as the portion passes through the wiper member while the applicator is being withdrawn, and the applicator element and wiper member are configured to provide a non-uniform distribution of the substance on the surface of the applicator element.

92. A device according to claim 91, wherein said wiper member is made of one of rigid and semi-rigid plastics material.

93. A device according to claim 91, wherein the wiper member is substantially non-deformable.

94. A device according to claim 91, wherein the applicator comprises a rod having the applicator element at one end, said rod not being deformed while said applicator is being withdrawn.

95. A device comprising:

a receptacle for containing a substance to be applied;

an applicator comprising a rod provided at one end with an applicator element; and a wiper member for wiping the rod and the applicator element while the applicator is being extracted from the receptacle, wherein the applicator element has an elastically deformable non circularly cylindrical body carrying along an entire length thereof at least one application member or defining an application surface along its entire length, said body forming a non-zero angle with the rod, and said body deforming elastically and having said angle vary to pass through the wiper member while the applicator is being withdrawn, and the applicator element and wiper member are configured to provide a non-uniform distribution of the substance on the surface of the applicator element.

96. A device according to claim 95, wherein said at least one application member is a flocking.

97. A device comprising:

a receptacle for containing a substance to be applied;

an applicator comprising a rod provided at one end with an applicator element; and a wiper member for wiping the rod and the applicator element while the applicator is being extracted from the receptacle, wherein the applicator element has an elastically deformable body non-symmetrical in shape around a longitudinal axis of said body, said body carrying along its entire length at least one application member or defining an application surface along the entire length of said body, said body forming a non-zero angle with the rod, and said body deforming elastically and having said angle vary to pass through the wiper member while the applicator is being withdrawn, and the applicator element and wiper member are configured to provide a non-uniform distribution of the substance on the surface of the applicator element.

98. A device according to claim 97, wherein said at least one application member is a flocking.

* * * * *